US006079909A

United States Patent [19]

Elmore et al.

[11] Patent Number: 6,079,909

[45] **Date of Patent: *Jun. 27, 2000**

[54] SYSTEM AND METHOD FOR WIDENING A HIGHWAY AND SUPPORTING A SOUND WALL

[75] Inventors: Jack Thomas Elmore, Washington, D.C.; Victor Elias, Bethesda; Longine Wojciechowski, Gaithersburg, both of Md.

[73] Assignee: JTE, Inc., Lorton, Va.

[ * ] Notice: This patent is subject to a terminal disclaimer.

[21] Appl. No.: 09/144,968

[22] Filed: Sep. 1, 1998

Related U.S. Application Data

[63] Continuation of application No. 08/893,649, Jul. 11, 1997, Pat. No. 5,809,716, which is a continuation of application No. 08/676,489, Jul. 8, 1996, Pat. No. 5,713,170, which is a continuation of application No. 08/427,368, Apr. 26, 1995, Pat. No. 5,537,788.

[51] Int. Cl.[7] ..... E02D 29/02

[52] U.S. Cl. ..... 405/284; 52/260; 52/258

[58] Field of Search ..... 52/258, 259, 260, 52/252, 741.11, 741.12, 741.13, 742.14; 405/284, 285, 286, 287, 292, 296

[56] References Cited

U.S. PATENT DOCUMENTS

| | | | |
|---|---|---|---|
| 451,733 | 5/1891 | Leonard . | |
| 3,530,676 | 9/1970 | York . | |
| 3,555,751 | 1/1971 | Thorgusen . | |
| 3,800,494 | 4/1974 | Hall et al. . | |
| 3,948,009 | 4/1976 | Bernhard . | |
| 4,071,223 | 1/1978 | Demarest . | |
| 4,269,545 | 5/1981 | Finney . | |
| 4,465,403 | 8/1984 | Schreiber et al. . | |
| 4,653,962 | 3/1987 | McKittrick et al. . | |
| 4,837,993 | 6/1989 | Studenski . | |
| 4,848,972 | 7/1989 | Trevisani . | |
| 4,911,585 | 3/1990 | Vidal et al. . | |
| 5,003,742 | 4/1991 | Dettbarn . | |
| 5,079,885 | 1/1992 | Dettbarn . | |
| 5,158,399 | 10/1992 | Flores . | |
| 5,274,971 | 1/1994 | Elmore et al. | 52/144 |
| 5,368,416 | 11/1994 | Cataldo . | |
| 5,392,572 | 2/1995 | Elmore et al. | 52/144 |
| 5,468,098 | 11/1995 | Babcock . | |
| 5,537,788 | 7/1996 | Elmore et al. | 52/258 |
| 5,572,847 | 11/1996 | Elmore et al. | 52/766 |
| 5,713,170 | 2/1998 | Elmore et al. | 52/258 |
| 5,809,716 | 9/1998 | Elmore et al. | 52/258 |

OTHER PUBLICATIONS

State of Maryland, Department Of Transportation, State Highway Administration, Blueprints, Concrete Retaining Wall, Interstate Route 97, Dated Oct. 18, 1993.

*Primary Examiner*—Carl D. Friedman
*Assistant Examiner*—Yvonne M. Horton
*Attorney, Agent, or Firm*—Nixon Peabody LLP; Thomas W. Cole

[57] ABSTRACT

A system and method for widening a highway and supporting a sound wall is provided that includes a single row of caissons for providing the sole foundation of a breast wall and a sound wall. The caissons include a vertically-oriented network of reinforcing steel, an upper portion of which is integrated into the steel reinforcing network of a cast-in-place breast wall. The sound wall is mounted on and supported by the top ends of the caissons and serves to obstruct the transmission of sound from the highway. The vertically-oriented reinforcing members of the caissons are spaced away from the center portion of each caisson in two opposing groups in order to maximize its bending strength in a direction orthogonal to the highway, which is the primary direction in which cut earth, compacted fill material, and winds apply bending moments to the breast wall and sound wall. The use of a single row of caissons having a high bending strength in a direction orthogonal to the highway minimizes the labor and materials necessary to support the breast wall and the sound wall, and advantageously minimizes the amount of space necessary to excavate and construct the foundation.

16 Claims, 6 Drawing Sheets

FIG. 1

SYSTEM AND METHOD FOR WIDENING A HIGHWAY AND SUPPORTING A SOUND WALL

This application is a continuation of U.S. patent application Ser. No. 08/893,649 filed Jul. 11, 1997 (now U.S. Pat. No. 5,809,716 issued Sep. 22, 1998), which in turn is a continuation of U.S. patent application Ser. No. 08/676,489 filed Jul. 8, 1996 (now U.S. Pat. No. 5,713,170 issued Feb. 3, 1998), which in turn is a continuation of U.S. patent application Ser. No. 08/427,368 filed Apr. 26, 1995 (now U.S. Pat. No. 5,537,788 issued Jul. 23, 1996).

BACKGROUND OF THE INVENTION

This invention is generally concerned with a system for widening a highway flanked by irregular terrain and for providing support for a sound wall.

Systems for widening highways flanked by irregular terrain are known in the prior art. Such systems may be used, for example, on highways paved along a ridge-like formation where the grade of the terrain drops off sharply from the sides of the highway, or where a highway is paved at the bottom of a gully-like depression where the terrain slopes sharply upwardly from the highway sides. More commonly, such systems are used to widen highways paved along the sides of hills or mountains where the terrain slopes upwardly on one side and downwardly on the other.

Such widening systems generally involve the installation of a retaining wall for retaining either a cut face of earth or fill material. In cases where the terrain slopes upwardly from the side of the highway, the ground is leveled by bulldozers and the like by cutting away and removing the earth adjacent to the flank of the highway. The retaining wall is then installed in order to retain the cut face of earth. The highway is then widened over leveled ground adjacent to the retaining wall. In cases where the terrain slopes downwardly from the highway, bulldozers and the like are used to cut a step or terrace in the earth along the line that is parallel to and spaced apart from the side of the highway. The retaining wall is then installed along the step or terrace, the wall being raised to at least the level of the highway. Fill material is then packed between the highway and the adjacent face of the retaining wall to level the terrain between these two points. Because of the large moment forces that such retaining walls are subjected to in holding back either a cut face of earth or compacted fill material, the bottom ends of such walls are often structurally connected to massive, steel reinforced foundations that are many times wider than the thickness of the wall sections. The use of such massive foundations necessitates the use of a substantial amount of materials and labor. Additionally, the deep and wide excavation necessary for the installation of such a foundation can make it difficult to limit the disruption of the terrain to only the area of the highway right-of-way (particularly where such right-of-way is narrow), and can result in the unwanted destruction of trees, creeks, and other environmental assets.

Acoustical wall systems for obstructing highway noises from residential areas are also known in the prior art. Such wall systems generally take three different forms, including self-supporting walls, monolithic post and panel precast walls, and post and panel precast walls. Of these three types of wall systems, post and panel acoustical walls are among the most adaptable for use on irregular terrain. Such acoustical walls employ panels that are slidably mounted and supported by structurally independent support posts. The support posts are typically steel or concrete columns having opposing pairs of flanges which slidably receive the side edges of the wall panels. During construction, a wall panel is raised by a crane above two adjacent support posts, and subsequently lowered between the posts after the side edges are aligned between the flange pairs. Either a single panel or a stack of panels may be mounted between two adjacent posts, thereby imparting valuable adjustability with respect to the height of the completed wall. With such a system, it is relatively easy to create a sound wall having a uniform height along a highway where the terrain varies in height either beside or in the direction of the highway.

Despite such advantages over other types of sound walls, post and panel walls also have their disadvantages. One major disadvantage stems from the necessity of having to leave some amount of slack in the distance between the flanges of the support posts and the thickness of the side edges so that the panels may be quickly aligned between the flanges and the beams prior to slidably lowering them between two flange pairs of adjacent posts. As a result of this slack, the front side edges of the panels cannot snugly engage the front flanges of their respective support posts, which if not corrected will create substantial acoustical leaks in the resulting wall, and poor structural alignment of the panels. In the past, this slack has been eliminated by the installation of steel angle members between the back flanges of the support posts and the back side edges of the panels to take up the unwanted slack. Unfortunately, the installation of such steel angles has proven to be an expensive and time consuming step in the assembly of such wall systems, as it requires the drilling of a specific pattern of holes through the flanges of the I-beams forming the support posts, the regalvanization of the I-beams, as well as the tedious installation of several nuts and bolts for every angle in such a way that they continuously apply pressure to the back side edges of the panels. Worse yet, the use of such steel angle members sometimes fails to permanently remove unwanted slack between the front side edges of the panels and the flanges of the posts because of the constant vibration that such wall systems are subjected to due to their proximity to a heavy flow of road traffic.

Combined retaining wall and sound wall structures are also known in the prior art. In such combined structures, a sound wall system is installed on top of the retaining walls used to retain either a cut face of earth or a fill material incident to a highway building or widening operation. Since additional moment forces may be applied to the retaining wall as a result of high winds blowing on the sound walls, the retaining walls in such a combined structure must be redesigned to accommodate these additional moment forces. In the past, this has been done by simply enlarging the already massive foundation slab that the retaining wall is connected to, and by further increasing the thickness of the wall sections. However, such a design solution considerably increases the already considerable amount of materials and labor necessary to construct the retaining wall, and requires an even larger excavation to construct.

Clearly, there is a need for an improved combination retaining wall and sound wall for widening a highway flanked by irregular terrain that overcomes the disadvantages associated with the prior art. Ideally, such a combination structure would be capable of bearing all of the moment forces exerted on the retaining wall plus the moment and compressive loads exerted by the acoustical sound wall without the need for substantial enlargements in the size of the retaining wall foundation or the thickness of the wall sections. Such a combined structure should further require only a very narrow strip of terrain for installation to maximize the use of relatively narrow highway right-of-ways, while minimizing the amount of excavation, filling, and other disruptions around the right-of-way. Finally, such a combined structure should utilize a post and panel sound wall having an alternative slack-removing means that does not necessitate the time consuming drilling of holes in the I-beams and installation of steel angles between the wall panels and the flanges of the posts.

SUMMARY OF THE INVENTION

Generally speaking, the invention is a system for widening a highway flanked by irregular terrain that comprises a combination retaining wall and sound wall wherein the sole foundation for both the retaining and sound walls is a single row of caissons. Each of the caissons is formed from concrete cast in a drilled-out hole in the earth into which a network of vertically-oriented reinforcing members has been placed. The retaining wall is preferably a breast wall that is likewise formed from concrete cast in a form over a network of reinforcing members. At least some of the vertical reinforcing members of the caissons are integrated into part of the reinforcing network of the sections of the breast wall to obviate the need for a separate foundation for the breast wall sections. A sound wall is in turn mounted on and supported by the upper ends of the caissons, which terminate along the upper edge of the breast wall sections. The network of vertically-oriented reinforcing members in the caissons is arranged to maximize resistance to the combined bending moment forces applied to the breast wall sections by the cut face of earth of fill material and the pressures of wind on the sound wall. To this end, the reinforcing members are divided up into two groups arranged in rows which are parallel to the direction of the highway, and which are spaced apart from the center portion of the caissons. The caissons may be cylindrical in shape, having a round cross-section. Each of the two row-like arrangements of reinforcing members is preferably spaced a distance of at least one-half of the radius of the cross-section away from the center portion of the caisson. In order to further maximize the bending strength of the caissons, the cross-sectional area of the steel is preferably the maximum amount allowed by the local building code, which is typically 2.12 percent of the total cross-sectional area of the caissons. Such an arrangement effectively maximizes the bending strength of the caissons in a direction against the bending forces applied to it from cut earth or fill material, and the action of wind pressure on the sound panels. Such selective maximization of the bending strength minimizes the amount of materials and labor necessary in constructing a foundation for the breast and sound walls.

The sound wall is preferably a post and panel type wall wherein the support posts are mounted on the top ends of the caissons. Each of the support posts preferably includes pairs of opposing flanges for receiving side edges of the sound wall panels. In the preferred embodiment, wedges are used to remove the slack between the front side edges of the sound wall panels, and the flanges of the support posts. The use of such a sound wall system advantageously provides a rapidly erectable sound wall that is easily height adjustable by the stacking of a greater or lesser number of panels. Additionally, the use of wedges to remove the slack between the panels and the flanges of the posts is far quicker and more efficient than the use of steel angles mounted by nuts and bolts.

The invention also encompasses a method for widening a highway flanked by irregular terrain. The method generally comprises the steps of excavating a level strip of ground in terrain that flanks the highway, and drilling a single row of vertically-oriented holes in the level strip of ground. Next, vertically-oriented reinforcing members, which may be steel bars, are laid in these holes. The reinforcing members are long enough so that their upper ends extend to the height of the breast wall sections that will ultimately be cast between the caissons. Next, a hardenable, cementitious material such as concrete is poured into the holes to form the lower portions of a single row of caissons. The upper portions of the caissons and sections of a breast wall are then simultaneously cast in a form placed over the lower portions of the caissons such that the upper ends of the caisson reinforcing members are integrated into the breast wall sections to reinforce the same. Finally, a sound wall that utilizes the previously described wedges to remove slack between the posts and panels is mounted on top of the upper ends of the caissons. Depending on the type of terrain, the ground between the caissons and the highway is either leveled prior to the construction of the breast wall by producing a cut face in the earth, or after the construction of the breast wall by the deposition and compaction of fill material in this area.

DETAILED DESCRIPTION OF THE PREFERRED EMBODIMENT

Figure 1:
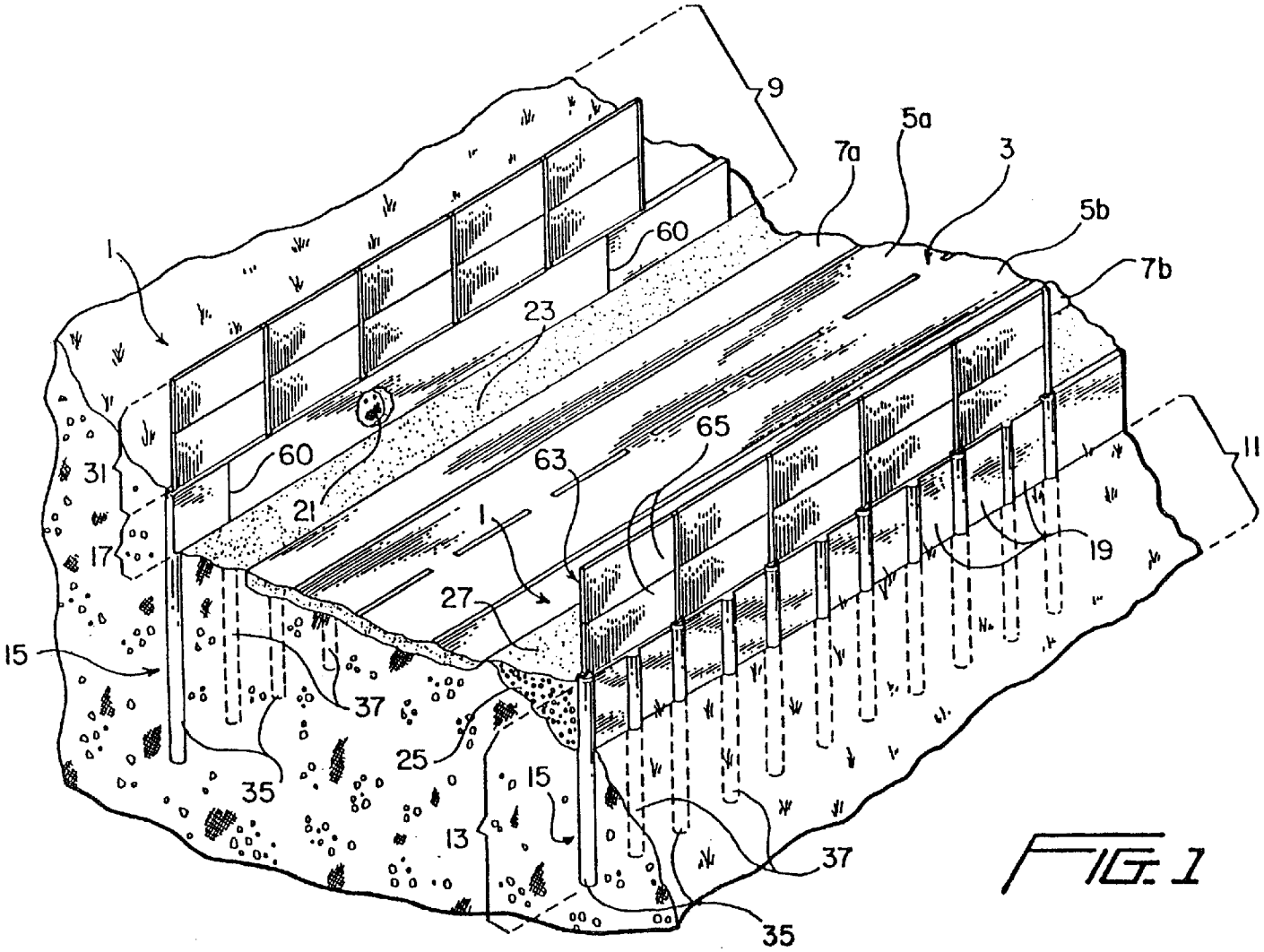
FIG. 1 is a perspective view of a highway widened by the system of the invention.
Figure 2:
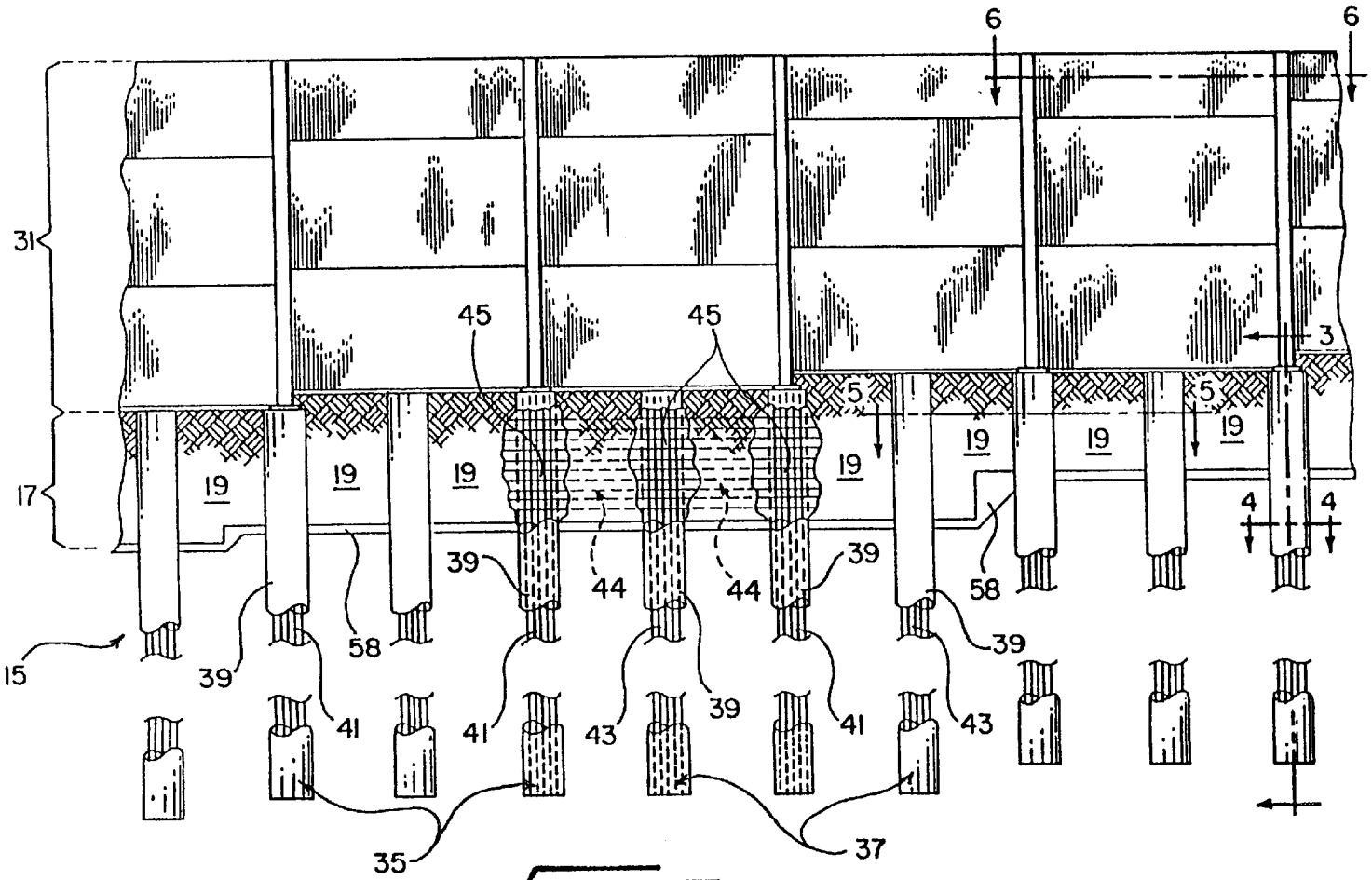
FIG. 2 is a side view of the system of the invention illustrating how the network of reinforcing steel of the breast wall sections is interconnected with the network of reinforcing steel used in the caissons.

With reference now to FIGS. 1 and 2, wherein like numerals designate like components throughout all of the several Figures, the highway widening system 1 of the invention widens a highway 3 flanked by irregular terrain by providing additional level terrain along the sides of the highway. Such a highway 3 may initially have only two adjacent traffic lanes 5*a,b* flanked by emergency lanes 7*a,b* as shown. In the particular example of the system illustrated in FIG. 1, one side of the highway 3 is flanked by ascending terrain 9, while the other side is flanked by descending terrain 11. However, the system 1 is adaptable to virtually any kind of irregular terrain.

The system 1 includes a foundation 13 formed from a single row 15 of caissons that advantageously forms the sole support for both a breast wall 17, and a sound wall 31. As will be described in more detail hereinafter, the breast wall 17 is comprised of adjacent, cast-in-place sections 19. When the system 1 is used to widen a highway 3 flanked by ascending terrain 9, earth moving equipment (not shown) such as bulldozers and the like is used to produce a cut face 21 in the earth and a level, widened portion 23 between the cut face 21 and the edge of the highway 3. In such a case, the breast wall sections 19 function to retain the cut face 21 of earth. When the system 1 is used to widen a highway 3 flanked by descending terrain 11, the system is installed along a line that is parallel to and spaced apart from the adjacent edge of the highway 3. Fill material 25 is then deposited and compacted between the breast wall sections 19 and the adjacent edge of the highway 3 in order to create a level, widened portion 27 of earth suitable for supporting a road bed. The widened portions 23,27 may be used to widen the highway 3 from a two lane to a four lane road. In either case, a sound wall 31 is installed on top of every other one of the caissons 15 forming the foundation 13 of the system 1 in order to at least partially prevent noise generated by vehicles on the highway 3 from reaching nearby residences or other buildings.

Figure 3:
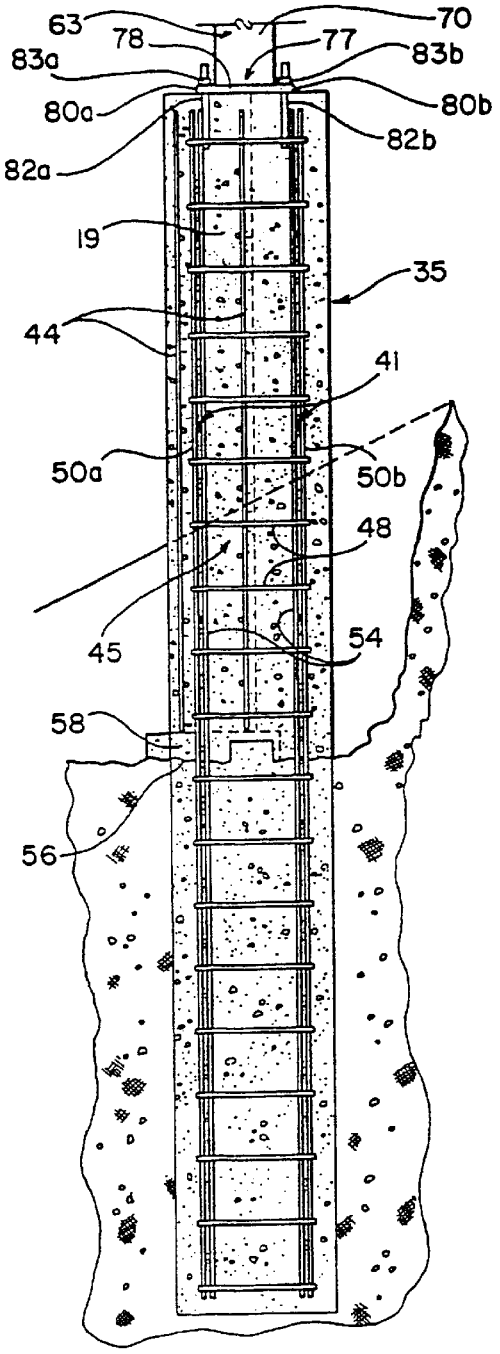
FIG. 3 is a cross-sectional side view of the highway widening system illustrated in FIG. 2 along the line 3—3.
Figure 5:
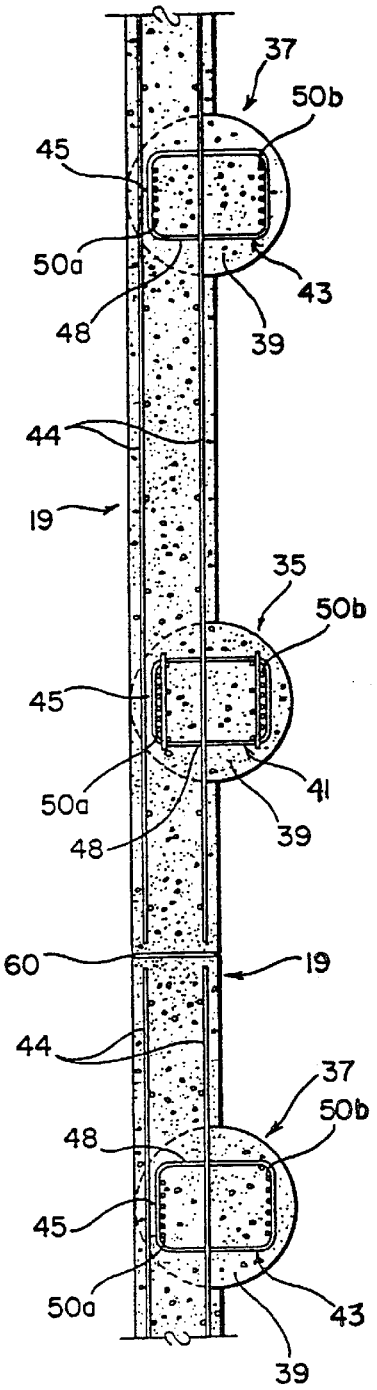
FIG. 5 is a partial cross-sectional top view of the system of the invention illustrated in FIG. 2 along the line 5—5.

With reference now to FIGS. 2, 3, and 5, the row 15 of caissons of the foundation 13 includes breast and sound wall supporting caissons 35 interspersed between caissons 37 that support the breast wall 17 only. The caissons 35,37 are formed from a column of concrete 39 cast in a drilled out hole over rectangularly shaped networks 41,43 of reinforcing steel, respectively. Above ground level, these reinforcing networks 41,43 are interspersed with a network 44 of steel used to reinforce the cast-in-place breast wall sections 19 to create structurally interconnected portions 45 of reinforcing steel, best shown in FIG. 2. As is best seen in FIG. 5, approximately half of the diameter of the cylindrically shaped caissons 35,37 are integrally cast within the breast wall sections 19. The structural interconnections between the reinforcing networks 41,43 of the caissons 35,37 and the reinforcing networks 44 of the breast wall sections 19, in combination with the integral casting of the column of concrete 39 within these wall sections 19, provides a breast wall 17 that is only as wide as the caissons 35, 37 but yet is amply capable of resisting the moment forces applied to it by either the cut face 21 or fill material 25 without the need for a broad foundation slab. The elimination of such a foundation slab in turn minimizes the need for labor, material, and land space as well as unwanted destruction of environmental assets on the highway right-of-way.

Figure 4:
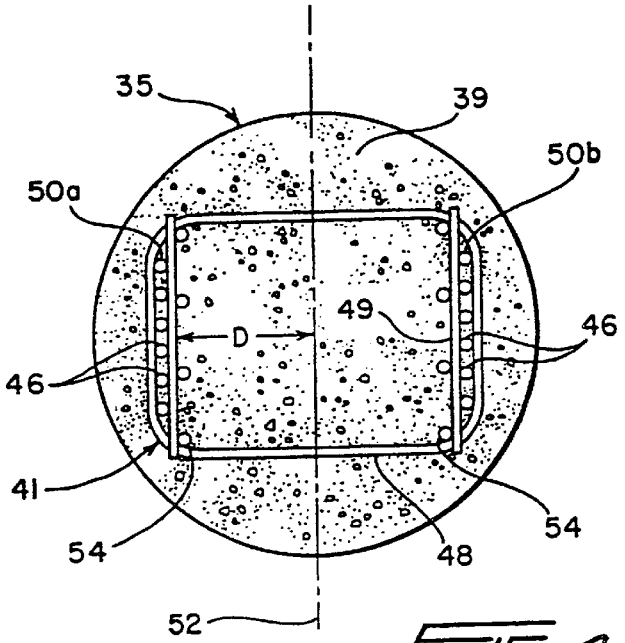
FIG. 4 is a cross-sectional view of one of the breast and sound wall supporting caissons illustrated in FIG. 2 along the line 4—4.

As is shown in FIGS. 4 and 5, in order to minimize the diameter of the caissons 35,37 that form the foundation 13 of the system 1, the vertically oriented reinforcing members 46 of the reinforcing networks 43,44 is arranged into two opposing rows 50*a,b* through the use of U-shaped stirrups 48 and tie bars 49. The two opposing rows 50*a,b* are spaced a minimum distance D away from a center line 52 that runs parallel with respect to the highway 3. In an example where the caissons are about 30 inches in diameter, the distance D corresponds to about 10 inches. More generally, the distance D should be at least one-half the radius of the caissons 35,37. Such an arrangement maximizes the bending resistance of the caissons 35,37 along a line orthogonal to the center line 52, which is the direction that the magnitude of the bending forces applied to the caissons 35,37 from earth or fill material is the greatest. Because of the additional bending load that the breast and sound wall supporting caissons 35 must bear as the result of the action of wind against the sound wall 31, the reinforcing network 41 of these caissons 35 includes an additional row 54 of vertically oriented reinforcing steel, as is best shown in FIG. 4. To maximize bending resistance, the total cross-sectional area of the vertically oriented reinforcing members 46 should be 2.12 percent of the total cross-sectional area of the column of concrete 39, which is the maximum permitted under present day building codes. In the example shown, adjacent caissons 35,37 are spaced eight feet from one another to provide adequate strength to the retaining wall, with the breast and sound wall caissons 35 being spaced sixteen feet apart to accommodate the sixteen foot spacing between the post assemblies of the sound wall 31.

To assist in the construction of the system 1 onto descending terrain 11, a level strip 56 of earth is provided (as is shown in FIG. 3). A leveling pad 58 is then installed after the bottom portions of the caissons 35,37 have been cast to facilitate the casting of the upper portion of the caissons 35,37, as will be explained in more detail shortly. Finally, expansion joints 60 are provided between various sections 19 of the breast wall 17 to accommodate the contraction and expansion of these sections 19 due to fluctuations in the ambient temperature. In the example shown in the several Figures, the expansion joints 60 are spaced every 32 feet from one another.

With reference now to FIGS. 3, 6, 7, and 8, the sound wall 31 of the system 1 generally comprises a plurality of post assemblies 63 vertically mounted on top of the caissons 35, as well as a plurality of precast panels 65 which are stacked between the post assemblies 63 to a height which is great enough to prevent unwanted noise from the highway 3 from directly impinging a group of residences or other buildings (not shown). As will be discussed in more detail hereinafter, slack between side edges of the panels 65 and the space between the parallel flanges of the beams forming the post assemblies 63 is expeditiously taken out by a plurality of wedge members 67 which serve to snug the front faces of the panels 65 into acoustically obstructing engagement with the front flanges of the posts 63.

Figure 6:
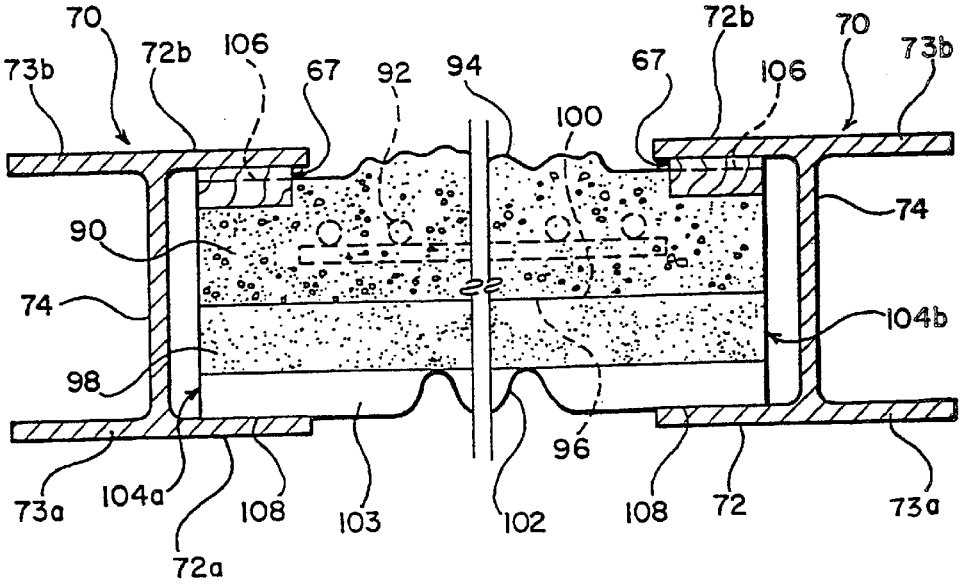
FIG. 6 is a cross-sectional top view of the sound wall of the system along the line 6—6 in FIG. 2.

With specific reference now to FIGS. 3 and 6, each of the post assemblies 63 is formed from an I-beam 70 having two pairs of opposing flanges 72*a,b* and 73*a,b* extending from a center web 74. The I-beam 70 may be galvanized steel, weathered steel, or concrete. While the top of the flanges of each of the beams 70 is illustrated as being square, these tops may include a taper to facilitate the alignment of the side edges of the panels 65 within the flange pairs 72*a,b* and 73*a,b*. As shown in FIG. 3, the bottom ends of each of the beams 70 includes a base assembly 77. The base assembly 77 is formed from a square base plate 78 welded to the bottom of the beams 70, which includes four stud holes 80*a–d*, of which only holes 80*a* and 80*b* are shown. The holes 80*a–d* receive studs or anchor bolts 82*a–d*, and the base plate 78 is secured onto the studs by means of nuts 83*a–d* as shown. The studs 82*a–d* extend down into and are secured within the caissons 35 as shown. The use of studs and nuts to secure the bottom ends of the beams 70 onto the caissons 35 not only allows the beams to be easily secured to and removed from the caissons 35 incident to wall assembly and removal operations, but further provides a means for adjusting the vertical orientation of the beams 70 so that they are substantially plumb prior to the lowering of wall panels 65 into the flange pairs 72*a,b* and 73*a,b*.

Figure 8:
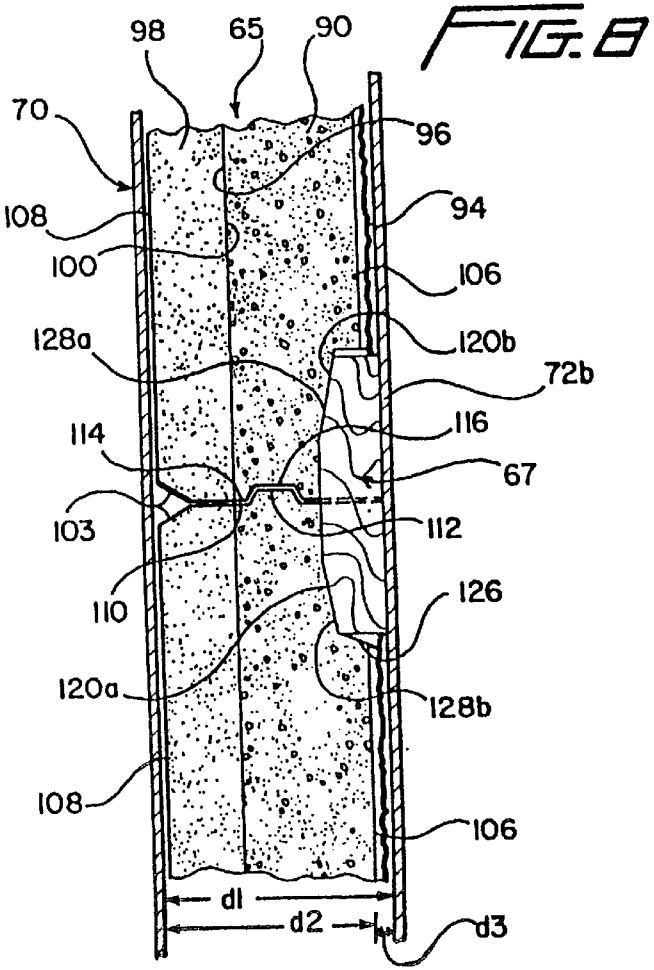
FIG. 8 is a side cross-sectional view of the sound wall of the system along the line 8—8 in FIG. 7.
Figure 7:
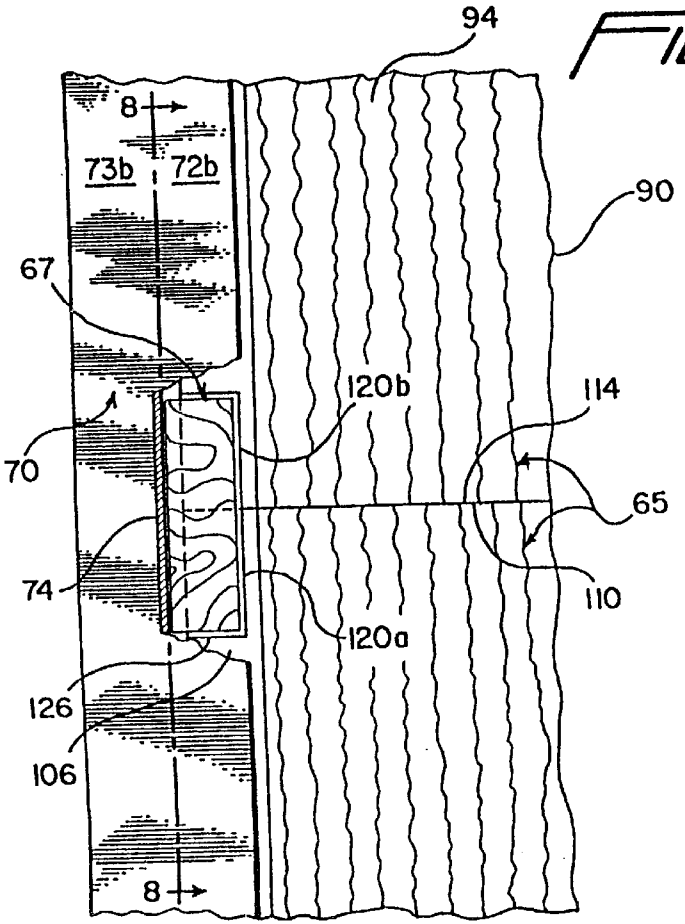
FIG. 7 is a partial back view of the sound wall of the system with a portion of the panel-retaining post broken away in order to make the wedging member visible.

With reference now to FIGS. 6, 7, and 8, each of the panels 65 of the sound wall 31 includes a support layer 90 of precast concrete strengthened by a network of reinforcing steel 92. The back surface 94 may have a rough or rake finish, while the front surface 96 is substantially flat. In the preferred embodiment, the front surface 96 of the support layer 90 is covered by a layer 98 of sound absorbing material such as Durisol (available from The Reinforced Earth Company located in Vienna, Va.), or Soundtrap (available from Smith Midland Corporation located in Midland, Va.). Both materials are porous, compressible compositions formed in part by concrete having large amounts of air void spaces. The sound absorbing layer 98 includes a flat back surface 100 which overlies the flat front surface 96 of the support layer 90 as well as a fluted front surface 102 for absorbing sound. The front surface 102 of the sound absorbing layer 90 is circumscribed by a bevel 103 as shown. Each of the panels 65 includes a pair of opposing side edges 104*a,b* having a generally planar back side edge 106, and planar front side edge 108. The top edge 110 of each of the panels 65 includes a sound obstructing key 112 which fits into a keyway 116 located at the bottom edge 114 of another panel 65 when two panels are stacked together as shown in FIG. 8. In addition to sound obstruction, the interfitting key 112 and keyway 116 further help to rigidify the wall resulting from the assembly of the sound wall 31.

Figure 10:
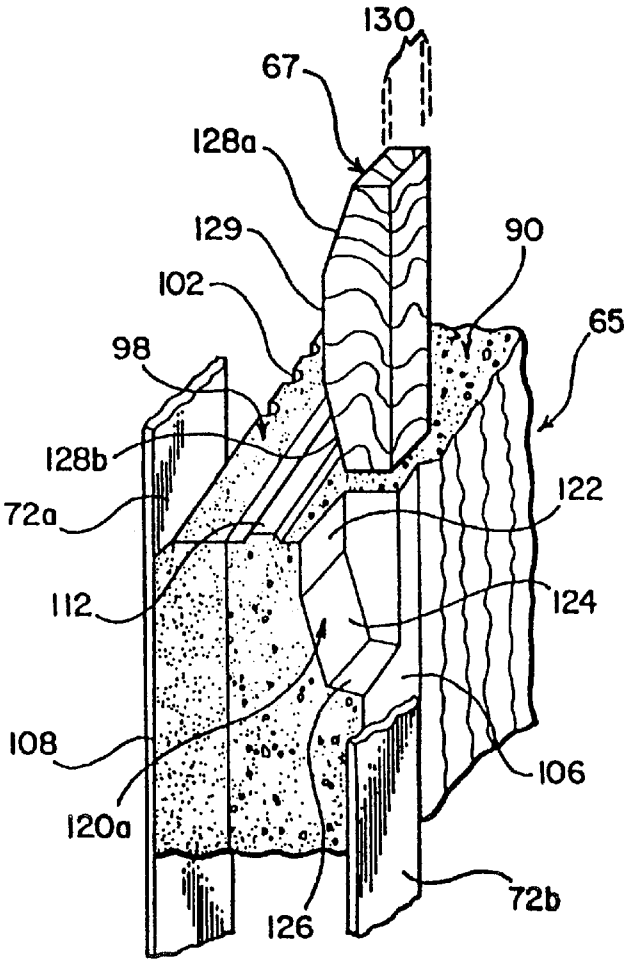
FIG. 10 is a partial perspective view of a corner of a wall panel used in the sound wall of the system illustrating how the sound member fits into a complementarily-shaped recess present in the panel.

With reference now to FIGS. 6, 7, 8, and 10, both the top and bottom ends of each of the planar back side edges 106 of every panel 65 include recesses 120*a,b* whose general locations are best seen with respect to FIG. 10. Each of the recesses 120*a,b* includes a flat upper section 122 bordered by a tapered wall 124 which are generally complementary to the lower half of a wedging member 67. The recesses 120*a* located on the upper ends of the planar back side edges 106 terminate in a bottom wall 126 which is slightly inclined relative to the horizontal so as to allow rain water which could otherwise soak the wooden wedging member 67 to drain out of the recess 120*a*.

As best seen in FIGS. 8 and 10, each of the wedging members 67 includes upper and lower tapered wedging surfaces 128*a,b* which are complementary in shape to the tapered walls 124 of upper and lower recesses 120*a,b*. The front portion of each of the wedging members 67 further includes a flat surface 129 which is approximately twice as long as the flat section 122 of either of the upper or lower recesses 120*a,b*. Finally, the back of the wedging member 67 includes a spacer portion generally indicated at 130 which is dimensioned to insure that when the wedging member 67 is inserted between the back flange 72*b* of a beam 70 and two mutually registering upper and lower recesses 120*a,b* of two different panels, the member 67 will apply a force sufficient to snug the planar front side edges 108 of the panel 65 into acoustically obstructing engagement with front flange 72*a* of the beam 70.

The wedging member 67 is preferably formed from a material with similar compressive properties as the material forming the front face of the panel 65. Hence, when a layer of relatively soft and brittle sound absorbing material 98 is applied over the front of the panel 65, the wedging member 67 is preferably formed from a soft and yielding wood, such as pine. Alternatively, if the front face of the panels 65 is formed from a relatively hard, sound reflective material such as smoothly finished concrete (as would be the case if the sound wall 31 were used to erect a sound reflective wall) the wedging member 67 is preferably formed from a hardwood such as oak or maple. In all cases where wood is used to form the wedging member 67, the wood is preferably pressure treated with aluminum salts to increase the members resistance to insects or fungi.

In all instances, the spacer portion 130 of the wedging member 67 is dimensioned to provide a snug engagement between the front side edges 106 of the panels 65 and the front flanges 72*a* of the beams 70 forming the post assemblies 63. Specifically, as is shown in FIG. 8, if the distance between flanges 72*a,b* is D1, and the distances between the front and back side edges 106 and 108 of the panel is D2, then the spacer portion 130 of the wedging member 67 will be dimensioned so that it is slightly larger than D3, the difference between D1 and D2.

In the first step of the method of the invention, the land is leveled where the foundation 13 of caissons 35,37 is to be constructed either by the production of the level, widened portion 23 of land next to the highway, or the level strip 56 previously discussed. A row of holes are first bored into the earth in order to form molds for the bottom portions of the caissons 35,37. The depth of the holes should be dimensioned so that the final height of the caisson is between two and three times the height of the breast wall sections 19. Next, reinforcing networks 41,43 of steel bars are tied together by way of the previously discussed stirrups 48 and tie bars 49. These reinforcing networks 41,43 are then positioned in the caisson holes such that the vertically oriented reinforcing members 46 present in each type of network 41,43 is oriented into the position illustrated in FIG. 4. Thus positioned, concrete is poured down the holes to the top of the level portion 33 or level strip 56 of earth produced prior to the boring of the caisson holes. Because the length of the vertically oriented reinforcing members 46 is substantially the same length of the completed caissons, the top portions of these members 46 will extend well above the top of the bottom portions of the caissons after the bottom portions have been cast. In the next step of the method, the previously discussed leveling pad 58 is cast over the tops of the partially formed caissons 35,37. Next, the reinforcing network 44 of the breast wall sections 19 is laid in the pattern illustrated in FIG. 2 such that members of the caisson reinforcing networks 41,43 are interspersed between members of the breast wall network 44. Concrete forms are then assembled over the leveling pad 58 from which the breast wall sections 19 are molded. These forms (not shown) include a semi-cylindrical shape on one side for molding the portion of the caissons 35,37 that projects out of the back of the retaining wall. At the top of these forms, the studs or anchor bolts 82*a–d* are positioned by wire retainers or the like. Concrete is then poured into the breast wall forms and allowed to harden.

Figure 9:
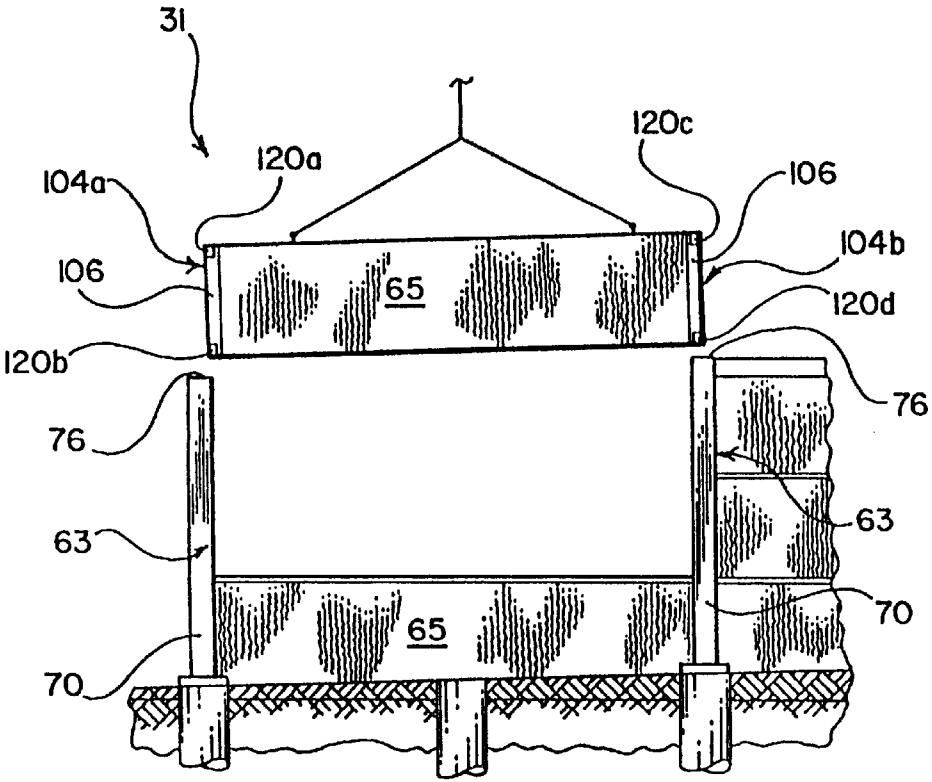
FIG. 9 is a side view of the sound wall of the system, illustrating how the sound wall is assembled.

In the final steps of the method, the sound wall 31 is assembled over the top ends of the caissons 35 by first installing the post assemblies 63 onto the studs or bolts 82*a–d* via nuts 83*a–d,* and then sliding wall panels 65 between opposing flanges 72*a,b* of the I-beams 70 of the post assemblies 63 as shown in FIG. 9. To expeditiously remove the slack between the side edges of the panels 65 and the flanges 72*a,b* of the I-beams 70, wedging members 67 are inserted into the complementary-shaped recesses 124 present in the comers of the wall panels 65 in the manner described in U.S. Pat. No. 5,392,572, the entire specification of which is incorporated herein by reference. As the panels 65 are slid between the flanges 72*a,b* of the I-beams 70, the weight of the panels cooperates with the inclined surfaces of the wedging members 67 to firmly press and retain the front side edges of the panels 65 against these flanges, thus obviating the need for bolt and angle type slack removers.

While this invention has been described with respect to a preferred embodiment, various modifications, additions, and improvements will become evident to a person of ordinary skill in the wall construction arts. All such modifications, additions, and improvements are intended to be within the scope of the invention, which is limited only by the claims appended hereto.

What is claimed:

1. A support structure for a breast wall for retaining ground or a fill material, said support structure designed to be embedded in terrain flanking a highway and comprising:

a row of spaced caissons formed so as to be embedded in said terrain flanking said highway to provide a foundation for said breast wall, said caissons including a caisson network of internal reinforcing members for strengthening said caissons and interlinking said caissons with said breast wall, the caissons being formed of cementitious material cast over said caisson reinforcing network and having ground level portions, said breast wall including a leveling pad formed from cementitious material cast between said ground level portions of said caisson and extending between and structurally interconnecting said caissons, said breast wall further including a breast wall network of reinforcing members, the breast wall being cast in place over said caisson and breast wall reinforcing networks.

2. The support structure of claim 1, wherein said cementitious material forming said caissons is integrated with the cementitious material forming said breast wall, and said breast wall has a cross section and, said caisson has a cross section which is greater than the cross section of said, breast wall.

3. The support structure of claim 1, wherein said caissons are substantially equally spaced apart at a multiple of about eight feet.

4. The support structure of claim 1, wherein said caisson network of reinforcing members includes at least one vertically oriented group of reinforcing members spaced outwardly from a center line of each said caisson and extending substantially parallel thereto, said breast wall reinforcing network including breast wall reinforcing members extending transverse to said vertically oriented group of reinforcing members.

5. The support structure of claim 1, further comprising a sound wall extending the top of said breast wall.

6. A support structure for a breast wall for retaining ground or a fill material, said support structure designed to be partially embedded in terrain flanking a highway and comprising:

a row of spaced caissons formed so as to be embedded in said terrain flanking said highway to provide a foundation for said breast wall, each of said caissons having a ground level portion and including a caisson network of internal reinforcing members for strengthening said caisson and interlinking said caisson with said breast wall, the caissons being formed of cementitious material cast over said caisson reinforcing network, said breast wall extending between said spaced caissons and including a breast wall network of reinforcing members that is interspersed with reinforcing members of said caisson networks, the breast wall also including a leveling pad formed from cementitious material that extends between and interconnects said caissons, said leveling pad being cast in place between said caissons and being connected to said caisson reinforcing networks.

7. The support structure of claim 6, wherein said breast wall has breast wall sections that are cast over said leveling pad and said reinforcing networks of said caissons and said breast wall to create structurally interconnected portions of reinforcing members, and wherein the cementitious material forming the caissons is integrated into the cementitious material forming the breast wall.

8. The support structure of claim 6, wherein said caissons are substantially equally spaced eight feet apart, and said reinforcing members are formed from reinforcing steel.

9. The support structure of claim 6, wherein said caisson network of reinforcing members includes at least one vertically oriented group of reinforcing members spaced outwardly from a center line of each said caisson and extending substantially parallel thereto, said breast wall reinforcing network including breast wall reinforcing members which are mutually parallel and extend transverse to said vertically oriented group of reinforcing members.

10. The support structure of claim 6, further comprising a sound wall extending along the top of said breast wall.

11. A system for widening a highway flanked by irregular terrain, comprising:

a row of caissons formed in terrain for providing a foundation for a breast wall and a sound wall, said caissons each having a ground level portion and being formed from hardenable cementitious material cast over a network of reinforcing members;

a breast wall including wall sections and a leveling pad that extends between and interconnects said caissons, said breast wall being formed from cementitious material cast over a network of reinforcing members that includes said network of reinforcing members of said caissons, wherein at least a portion of the cementitious material forming the leveling pad of the breast wall is integrally cast over the cementitious material forming the caissons at said ground level portions thereof.

12. The system of claim 11, wherein said caissons are spaced a multiple of about eight feet apart, and further comprising a sound wall supported by said breast wall.

13. The system of claim 11, wherein said caisson network of reinforcing members includes at least one vertically oriented group of reinforcing members spaced outwardly from a center line of each said caisson and extending substantially parallel thereto, said breast wall reinforcing network including breast wall reinforcing members extending transverse to said vertically oriented group of reinforcing members.

14. A method for widening a highway flanked by irregular terrain and for providing support for a sound wall comprising the steps of:

excavating a level strip of ground in said terrain that is parallel to said highway;

drilling a single row of vertically oriented holes in said level strip of ground;

laying vertically oriented caisson reinforcing members in said holes whose upper ends extend above said holes;

pouring a hardenable, cementitious material into said holes to fill said holes to substantially ground level and form a row of spaced, support members, ground embedded;

casting a hardenable, cementitious material between the ground level portions of said support members to form a leveling pad that extends between said support members;

providing a breast wall network of reinforcing members over said leveling pad and support members such that at least some of the upper ends of said caisson reinforcing members are interspersed throughout said breast wall network of reinforcing members, and casting a hardenable, cementitious material over said leveling pad and support members to form breast wall sections that are reinforced by both said caisson and breast wall reinforcing members.

15. The method of claim 14, further including the step of mounting a sound wall on top of said breast wall.

16. The method of claim 15 which includes drilling said holes substantially eight feet apart.

* * * * *